US008721207B2

(12) United States Patent
Sekino et al.

(10) Patent No.: US 8,721,207 B2
(45) Date of Patent: May 13, 2014

(54) PAPER DISCHARGE APPARATUS, PAPER DISCHARGE METHOD, IMAGE FORMING APPARATUS AND IMAGE FORMING METHOD

(75) Inventors: Toshiharu Sekino, Shizuoka (JP); Yasuo Amano, Singapore (SG)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 439 days.

(21) Appl. No.: 13/033,698

(22) Filed: Feb. 24, 2011

(65) Prior Publication Data

US 2012/0010061 A1 Jan. 12, 2012

(30) Foreign Application Priority Data

Jul. 12, 2010 (JP) ..... 2010-158173

(51) Int. Cl.

| | |
|---|---|
| ***B41J 11/66*** | (2006.01) |
| ***B41J 11/70*** | (2006.01) |
| ***B65H 29/60*** | (2006.01) |
| ***B41J 29/38*** | (2006.01) |

(52) U.S. Cl.

USPC ..... 400/621; 271/288; 271/188; 271/296; 271/303; 493/395; 493/460

(58) Field of Classification Search

USPC ..... 493/395, 460; 271/288, 296, 303, 305, 271/188; 400/621

See application file for complete search history.

(56) References Cited

U.S. PATENT DOCUMENTS

| | | | | |
|---|---|---|---|---|
| 3,685,690 | A * | 8/1972 | Karecki et al. | 221/218 |
| 4,095,781 | A * | 6/1978 | Kistner et al. | 271/12 |
| 4,319,132 | A * | 3/1982 | Guibord et al. | 235/379 |
| 4,381,445 | A * | 4/1983 | Jenkins et al. | 235/379 |
| 4,423,826 | A * | 1/1984 | Hirata et al. | 221/100 |
| 5,215,393 | A | 6/1993 | Wincent | |
| 5,461,469 | A * | 10/1995 | Farrell et al. | 399/407 |
| 5,649,776 | A * | 7/1997 | Sugimoto et al. | 400/617 |
| 5,779,379 | A * | 7/1998 | Mason et al. | 400/621 |
| 5,899,453 | A * | 5/1999 | Middelberg et al. | 271/184 |
| 5,954,438 | A * | 9/1999 | Klein et al. | 400/621 |
| 6,056,460 | A * | 5/2000 | Suzuki | 400/621 |

(Continued)

FOREIGN PATENT DOCUMENTS

| | | |
|---|---|---|
| EP | 0512103 | 8/1995 |
| JP | 1993-503494 | 7/1993 |

(Continued)

OTHER PUBLICATIONS

Japanese Office Action for Japanese Patent Application No. 2010-158173 mailed on Apr. 24, 2012.

*Primary Examiner* — David Banh

(74) *Attorney, Agent, or Firm* — Amin, Turocy & Watson, LLP

(57) ABSTRACT

A paper discharge apparatus includes a conveying path configured to convey a paper from an upstream portion to a downstream portion. A preventing mechanism is provided on the conveying path. The preventing mechanism is configured to prevent the paper from being conveyed to the downstream portion by pushing the paper or blocking the conveying path. A control unit is configured to bend the paper by preventing the conveyance of the paper by using the preventing mechanism, and then convey the paper to the downstream portion of the conveying path for discharge of the paper from the conveying path.

10 Claims, 18 Drawing Sheets

(56) References Cited

U.S. PATENT DOCUMENTS

| | | | | |
|---|---|---|---|---|
| 6,126,162 | A * | 10/2000 | Ueda et al. | 271/198 |
| 6,229,983 | B1 * | 5/2001 | Sawada | 399/385 |
| 6,428,226 | B1 | 8/2002 | Suzuki et al. | |
| 6,519,441 | B1 * | 2/2003 | Sawada | 399/384 |
| 6,662,721 | B2 * | 12/2003 | Fujishiro | 101/228 |
| 7,048,457 | B2 * | 5/2006 | Harris | 400/635 |
| 8,075,211 | B2 * | 12/2011 | Yamamoto | 400/621 |
| 2002/0020962 | A1 * | 2/2002 | Takeda | 271/314 |

FOREIGN PATENT DOCUMENTS

| | | |
|---|---|---|
| JP | 08-073095 | 3/1996 |
| JP | 11-115263 | 4/1999 |
| JP | 2002-302314 | 10/2002 |

* cited by examiner

PAPER DISCHARGE APPARATUS, PAPER DISCHARGE METHOD, IMAGE FORMING APPARATUS AND IMAGE FORMING METHOD

CROSS-REFERENCE TO RELATED APPLICATIONS

This application is based upon and claims the benefit of priority from Japanese Patent Application No. 2010-158173, filed on Jul. 12, 2010, the entire contents of which are incorporated herein by reference.

FIELD

Embodiments described herein relate generally to a paper discharge apparatus, a paper discharge method, an image forming apparatus and an image forming method for discharging a printed paper after printing is completed.

BACKGROUND

In general, an image forming apparatus discharges printed papers through a conveying path by a paper discharge mechanism provided at an end of the apparatus. Thus, users can take the discharged papers.

If the paper discharge apparatus exposes the papers outside of the apparatus before completing the printing, a user may mistakenly pull the paper out of the apparatus. Therefore, it is desirable that the image forming apparatus or the paper discharge apparatus discharge the papers after completing necessary processes such as printing.

In order to avoid the case when a user mistakenly pulls the paper before printing is completed, in the paper discharge apparatus or paper image forming apparatus as described above, the printed papers should be discharged outside of the apparatus after completing necessary processes such as printing.

DETAILED DESCRIPTION

According to one embodiment, a paper discharge apparatus includes a conveying path configured to convey a paper from an upstream portion to a downstream portion. A preventing mechanism is provided on the conveying path. The preventing mechanism is configured to prevent the paper from being conveyed to the downstream portion by pressing the paper or blocking the conveying path. A control unit is configured to bend the paper by controlling the preventing mechanism to prevent the paper from being conveyed to the downstream portion, and then convey the paper to the downstream portion of the conveying path for discharge of the paper from the conveying path.

Figure 1:
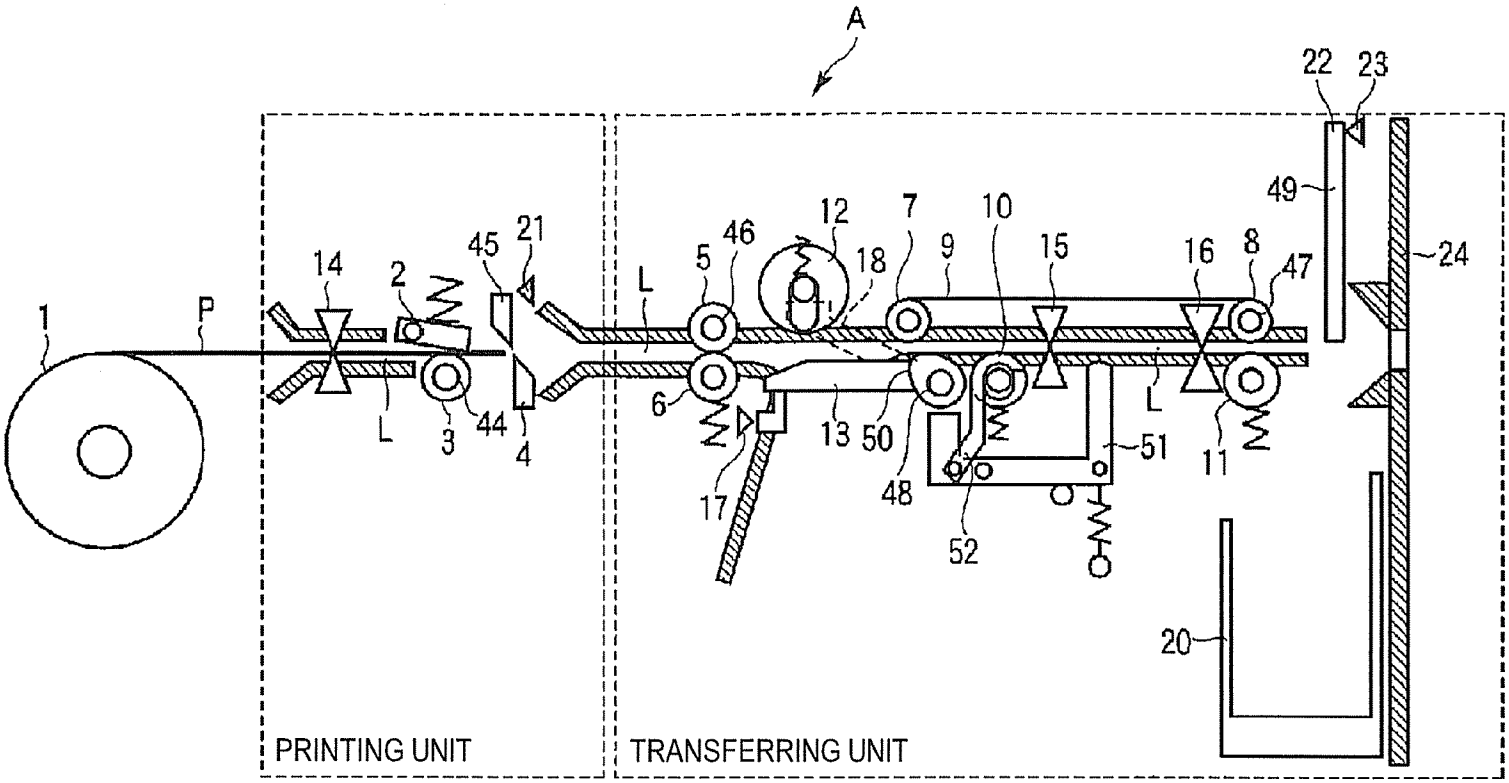
FIG. 1 is a cross-sectional view showing an example configuration of an image forming apparatus according to one embodiment.

Embodiments will now be described in detail with reference to the drawings. FIG. 1 is a cross-sectional view showing an example configuration of an image forming apparatus, and FIG. 2 is a block diagram showing an exemplary image forming apparatus.

An image forming apparatus A (or a paper discharge apparatus), as shown in FIG. 1, includes a paper roll 1 for providing a paper P and a conveying path L through which the paper P travels to a downstream portion thereof. In addition, along the conveying path L from an upstream portion thereof to the downstream portion, the image forming apparatus A includes, as elements of a printing mechanism, a paper end sensor 14, a thermal printer head 2 configured to print characters or the like on the paper P, a platen roller 3 driven by a platen motor 44 located at the opposite side of the thermal printer head 2, a cutter 4 configured to cut the paper P, a'cutter motor 45 configured to drive the cutter 4 and a cutter home position sensor 21 configured to detect a home position of the cutter 4.

Further, along the conveying path L from the upstream portion to the downstream portion, the image forming apparatus A includes, as elements of a transferring mechanism, a first feed roller 5 driven by a first feed motor 46, a first pinch roller 6, a loop roller 12, a flapper 13 configured to provide a space for bending the paper P along the conveying path L, a flapper home position sensor 17 configured to detect a home position of the flapper 13, a flapper motor 48 configured to open the flapper 13, and a lift arm 18 connected to the flapper motor 48. In addition, the image forming apparatus A includes a first belt pulley 7, a second belt pulley 8 connected to a second feed motor 47, a tensioned feed belt 9 extending between the first belt pulley 7 and the second belt pulley 8, a second pinch roller 10, a shutter 51 configured to prevent the paper P from being conveyed to the downstream portion of the conveying path L before the printing is completed, a link arm 52 connected to the shutter 51 and configured to open the second pinch roller 10, a paper entry sensor 15, a paper discharge sensor 16 provided downstream of the paper entry sensor 15, and a third pinch roller 11 provided at a position corresponding to the second belt pulley 8. The image forming apparatus A further includes a capture motor 49, a capture shutter 22 connected to the capture motor 49, a capture shutter home position sensor 23, a capturing bin 20 in which the paper P may be accommodated by being pushed by the capture shutter 22 and a case 24 of the image forming apparatus having an outlet for discharging the paper P.

Figure 2:
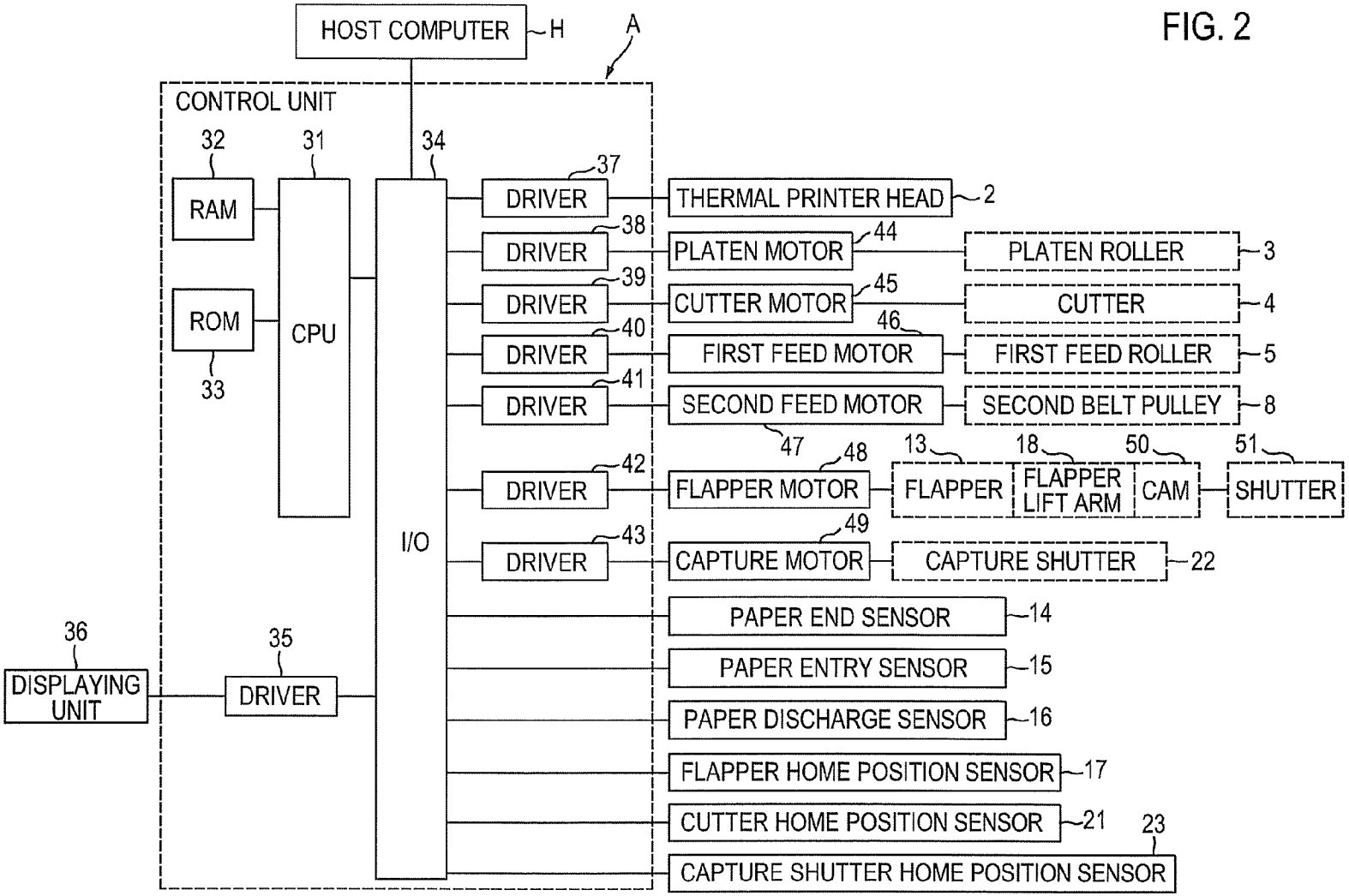
FIG. 2 is a block diagram showing an exemplary image forming apparatus according to one embodiment.

FIG. 2 illustrates an electrical configuration of the image forming apparatus A (or a paper discharge apparatus in which the thermal printer head 2 is not equipped) according to one embodiment. As shown in FIG. 2, the image forming apparatus A includes a control unit (or CPU) 31 which may control the entire operation of the apparatus, a RAM 32 and a ROM 33 configured to store control information, operational information, management information and control programs and so on, and an interface (I/O) 34 connected to various drivers 35, 37, 38, 39, 40, 41, 42 and 43 and an external host computer H.

Further, the image forming apparatus A includes a display unit 36 configured to display operational information and management information, the thermal printer head 2 coupled to the driver 37 to print information on the paper P, the platen motor 44 coupled to the driver 38, the platen roller 3 driven by the platen motor 44. The image forming apparatus A further includes the cutter motor 45 coupled to the driver 39, the cutter 4 driven by the cutter motor 45, the first feed motor 46 coupled to the driver 40, the first feed roller 5 coupled to the first feed motor 46, the second feed motor 47 coupled to the driver 41, the second belt pulley 8 coupled to the second feed motor 47. In addition, the image forming apparatus A includes the flapper motor 48 coupled to the driver 42, the flapper 13 connected to the flapper motor 48, the lift arm 18 coupled to the flapper motor 48, a cam 50 also coupled to the flapper motor 48, the shutter 51 mechanically controlled, e.g., to open/close, by the cam 50 coupled to the flapper motor 48, the capture motor 49 coupled to the driver 43 and the capture shutter 22 coupled to the capture motor 49.

Furthermore, the image forming apparatus A includes the paper end sensor 14, the paper entry sensor 15, the paper discharge sensor 16, the flapper home position sensor 17, the cutter home position sensor 21 and the capture shutter home position sensor 23, which are coupled to the interface 34.

Figure 14A:
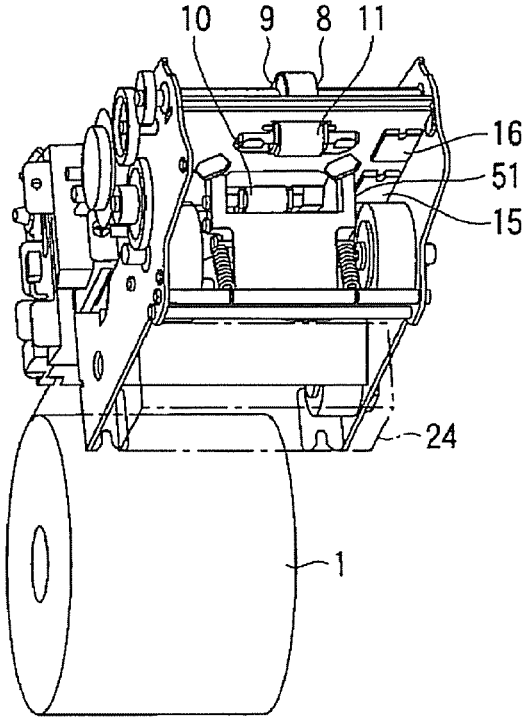
FIGS. 14A and 14B are perspective views showing an example of the mechanical configuration of the image forming apparatus.
Figure 14B:
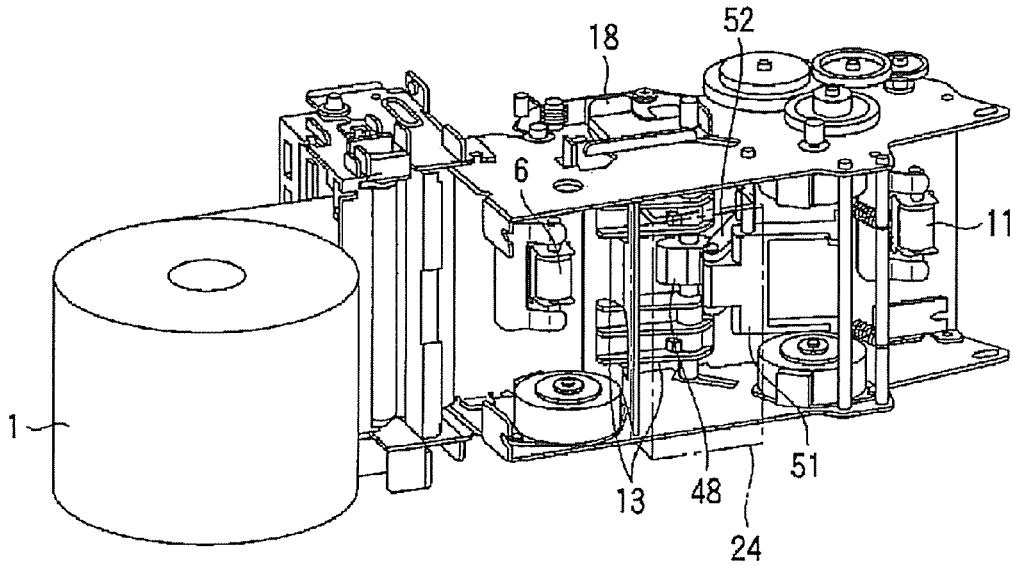

In FIGS. 14A and 14B, example mechanical configurations of the image forming apparatus A (or the paper discharge apparatus) are illustrated. FIG. 14A is a perspective view of the image forming apparatus A, when viewed from the top side thereof, while FIG. 14B is a perspective view of the image forming apparatus A, when viewed from the bottom side thereof, which provides the detailed positional arrangements between the elements described above.

Figure 15:
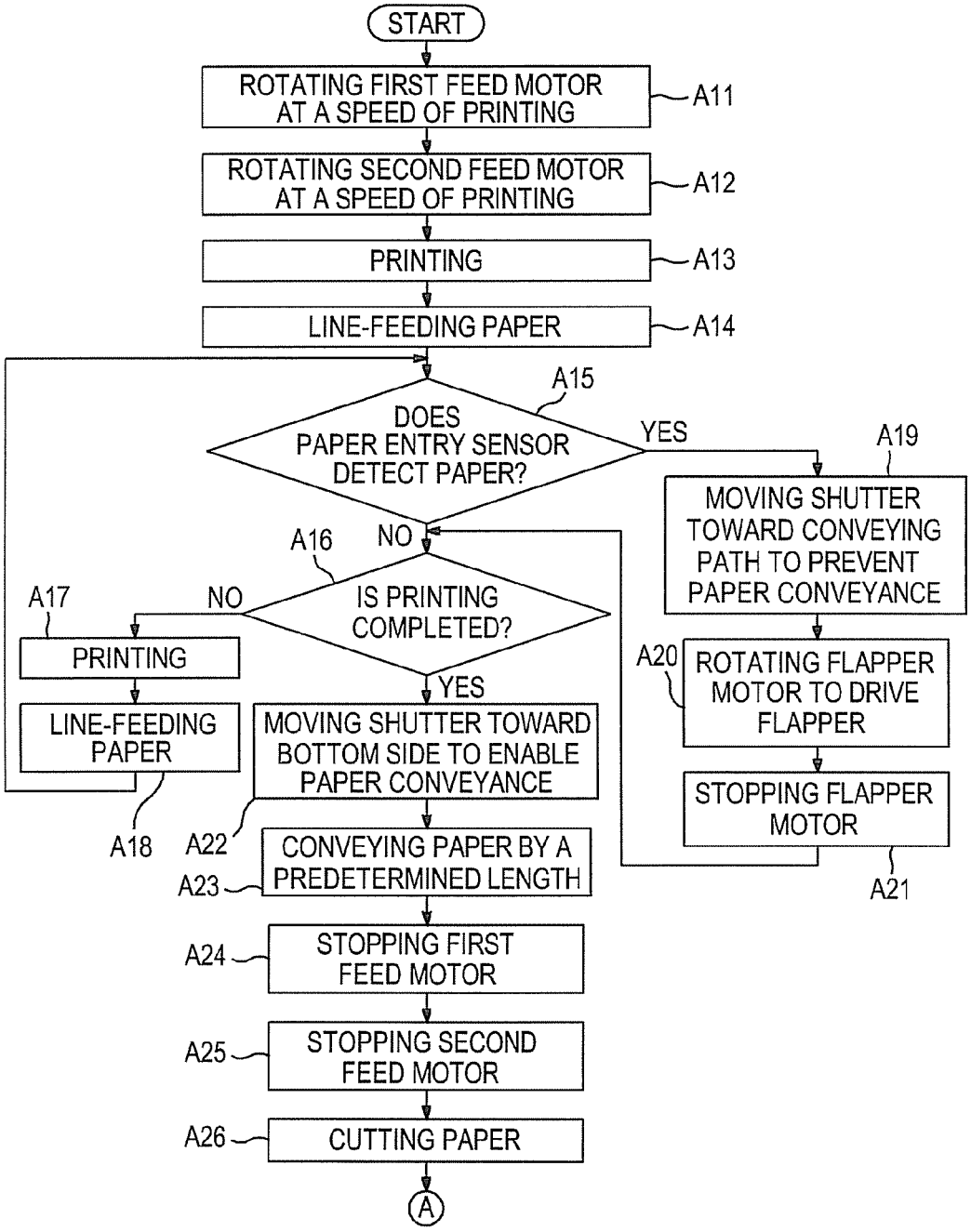
FIGS. 15 to 17 are a flowchart showing an example operation of the image forming apparatus.
Figure 16:
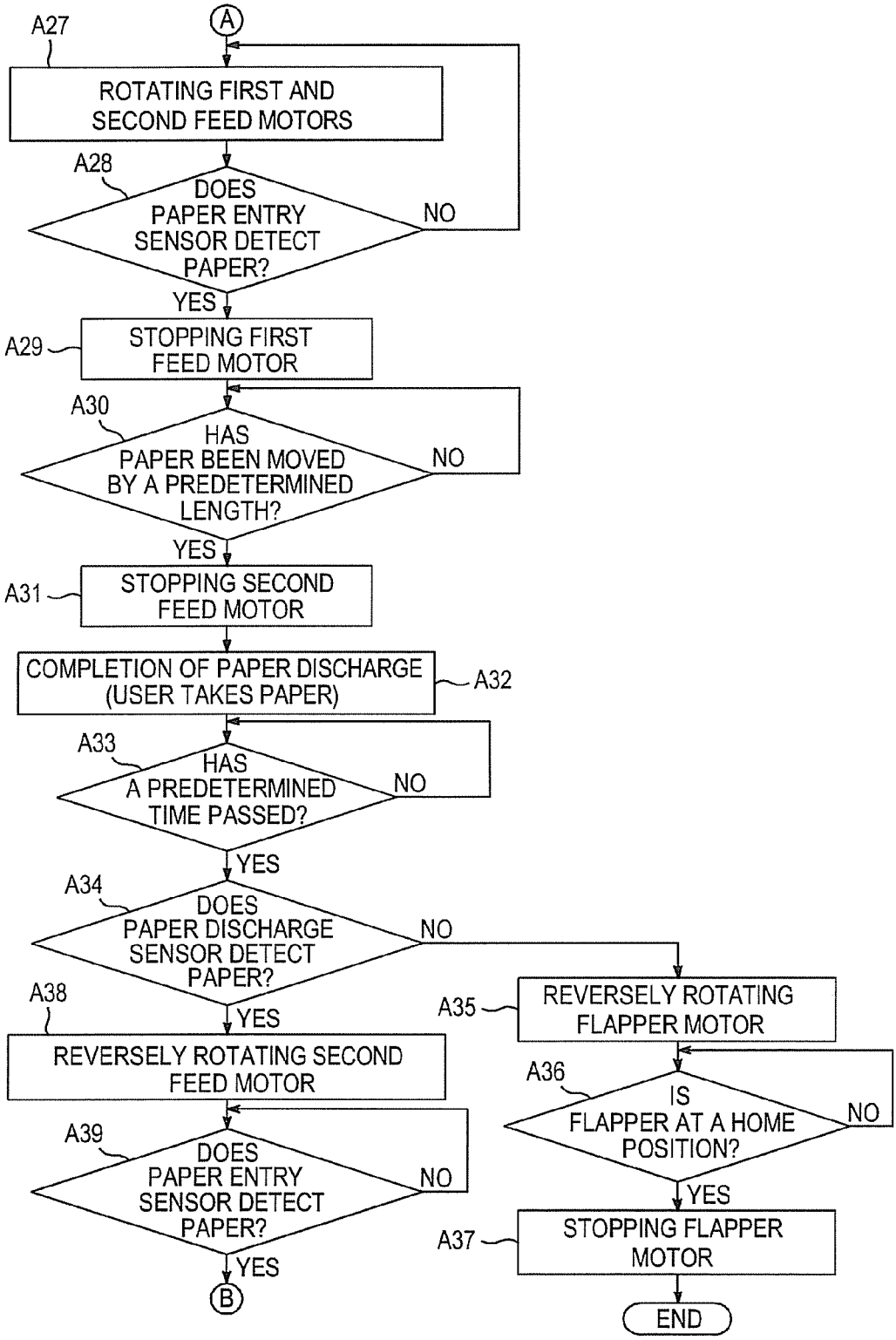
Figure 17:
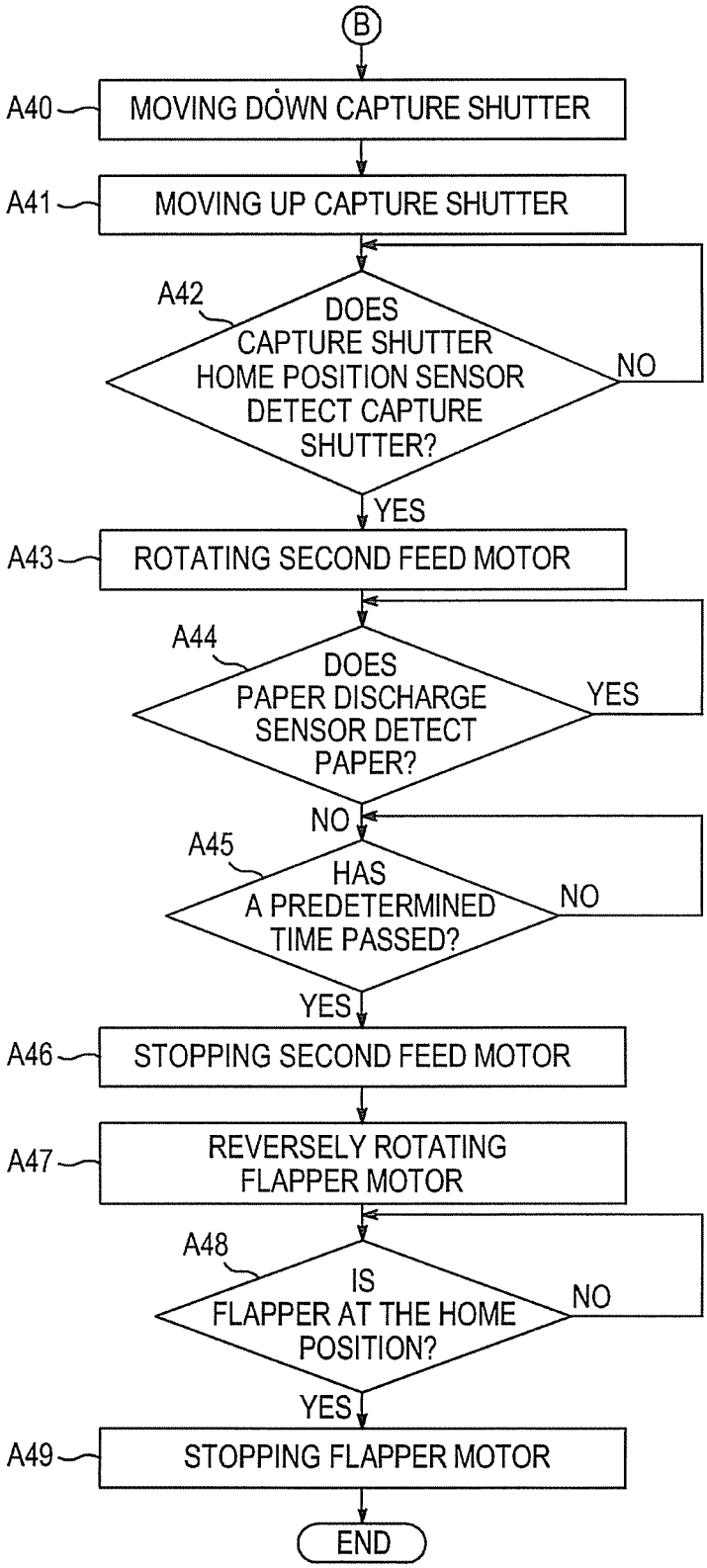

The operation of the image forming apparatus A having the above-described configuration will be explained below in detail with reference to the cross-sectional views of FIG. 1, FIGS. 3 to 13, and the flow charts shown in FIGS. 15 to 17. In the present disclosure, the paper discharge apparatus is operated in the same manner as the image forming apparatus A except that the image forming apparatus A may further perform a printing function.

First, under the control of the CPU 31, the paper P supplied from the paper roll 1, is conveyed along the conveying path L. The first feed motor 46 rotates at the same speed as that of printing conducted by the thermal printer head 2 (Act A11). Similarly, the second feed motor 47 rotates at the same speed as that of printing conducted by the thermal printer head 2 (Act A12). The thermal printer head 2 prints, for example, one line of characters, on the paper P (Act A13). When the printing of one line is completed, the paper P is line-fed by a distance corresponding to the printed line (Act A14).

Figure 3:
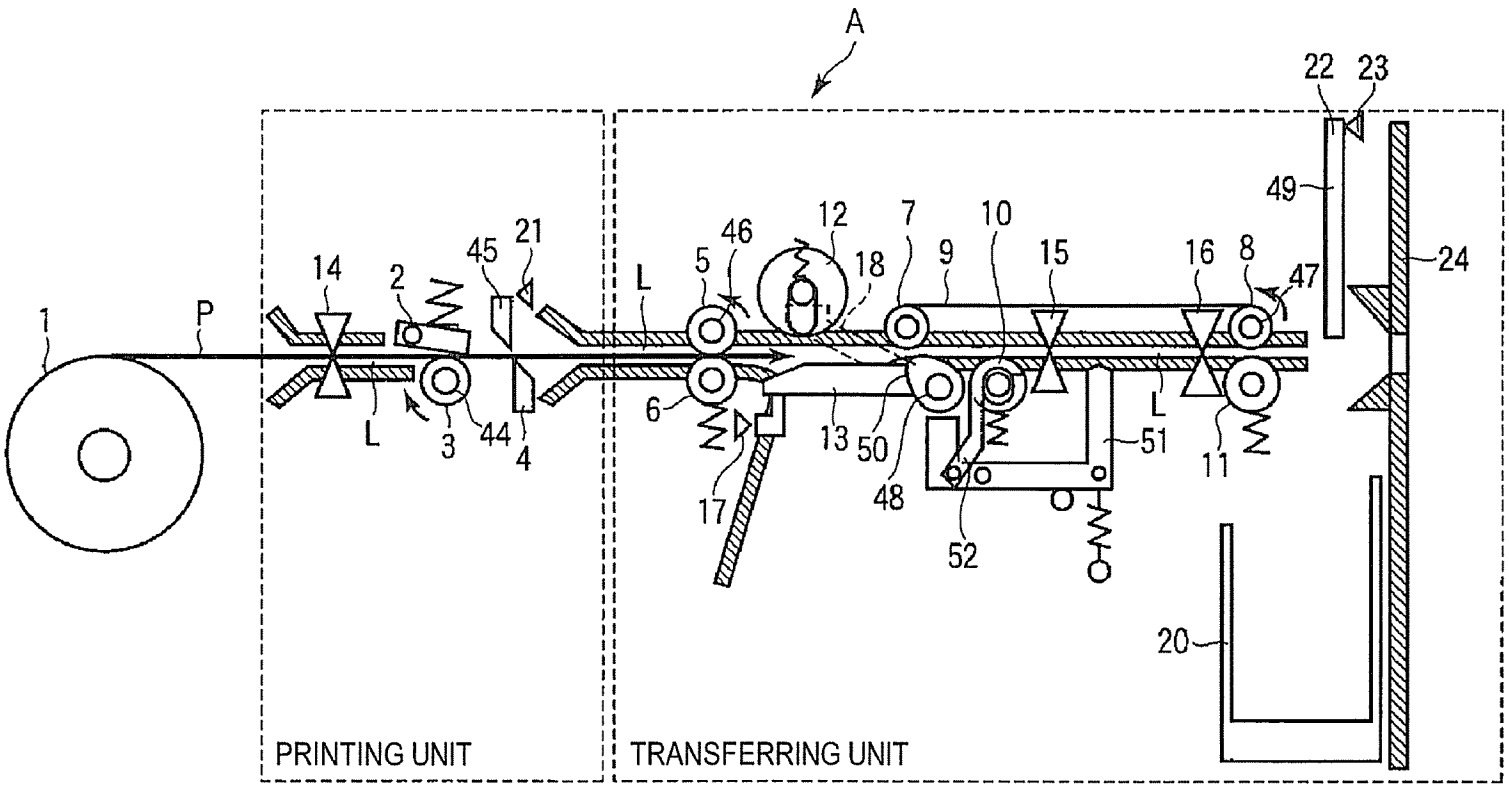
FIG. 3 is a cross-sectional view showing a configuration of printing on a paper in the image forming apparatus.

Under the control of the CPU 31, a determination of whether the paper entry sensor 15 detects the paper P (Act A15) and a determination of whether the printing is completed (Act A16) are repeatedly performed until the printing is completed, as shown in the cross-sectional views of FIGS. 1 and 3. If the printing is not completed, the thermal printer head 2 continues to print information such as characters on the paper P (Act A17), while the paper P being line-fed by a distance corresponding to the number of printed lines (Act A18). If the printing is completed before the paper entry sensor 15 detects the leading end of the paper P, the paper P is further conveyed by a predetermined length, e.g. by a distance corresponding to m (where m is a natural number) lines of print data (Act A23) and then the first feed motor 46 is stopped (Act A24). The second feed motor 47 is also stopped (Act A25)

Figure 4:
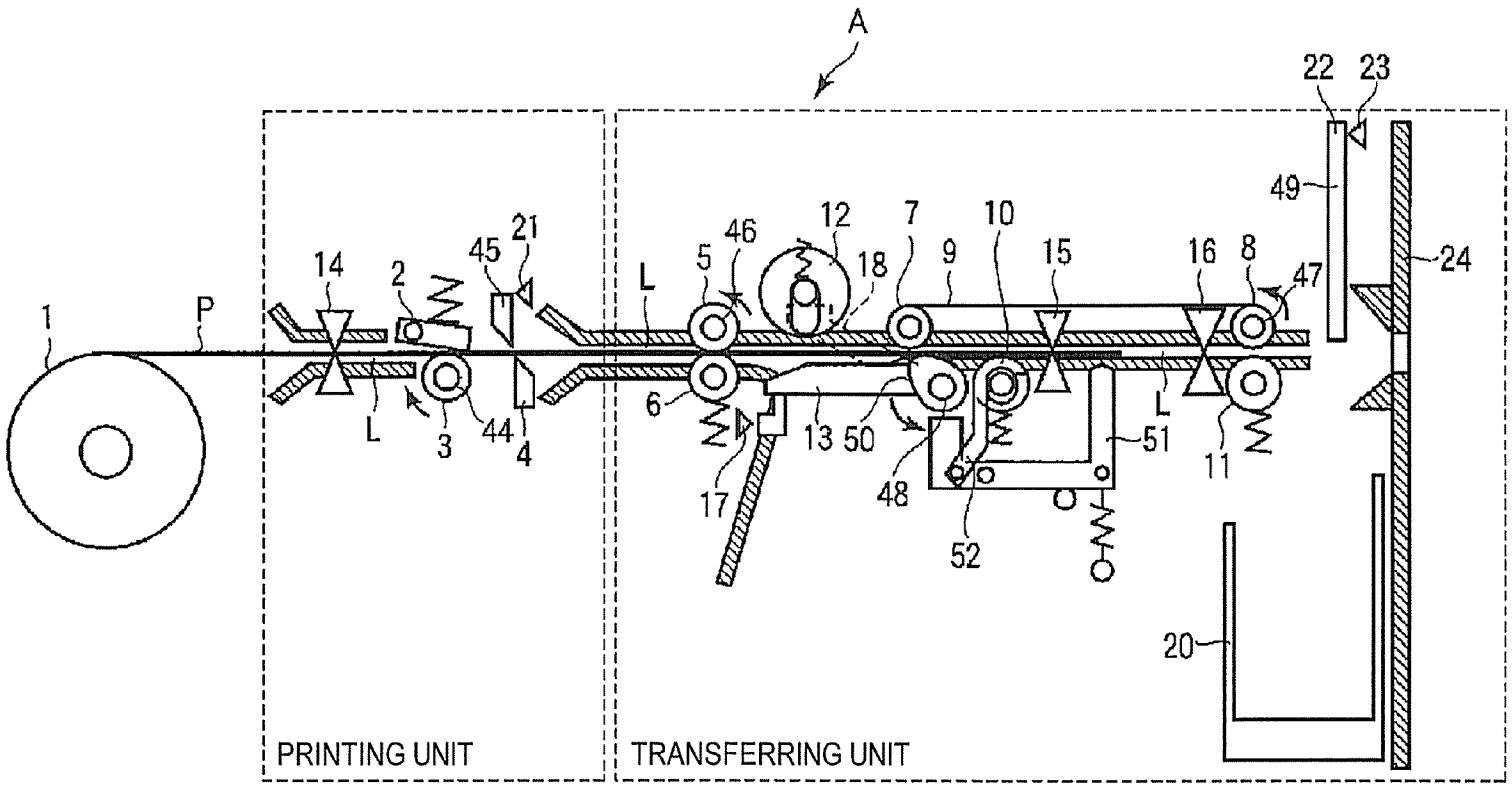
FIG. 4 is a cross-sectional view showing a configuration of conveying the printed paper in the image forming apparatus.

As shown in the cross-sectional view of FIG. 4, when it is determined that the paper P arrives at the paper entry sensor 15 (Act A15) and that the printing is not completed (Act A16), the shutter 51 moves toward the conveying path L, by the cam 50 rotated by the flapper motor 48, to prevent the paper P from being conveyed to the downstream portion of the conveying path L, under the control of CPU 31 (Act A19). At the same time, the second pinch roller 10 is moved downward by the movement of the link arm 52 in response to the movement of the shutter 51. With the above arrangement, the paper P may be pressed by the shutter 51 or, simply, the conveying path L may be blocked to prevent the continued conveyance of the paper P. The paper P starts bending by the shutter 51. At the same time, under the control of the CPU 31, the flapper motor 48 rotates to drive the flapper 13 to move towards the bottom side of the apparatus (Act A20). When the flapper 13 is substantially directed towards the bottom side, the rotation of the flapper motor 48 is stopped (Act A21).

Figure 5:
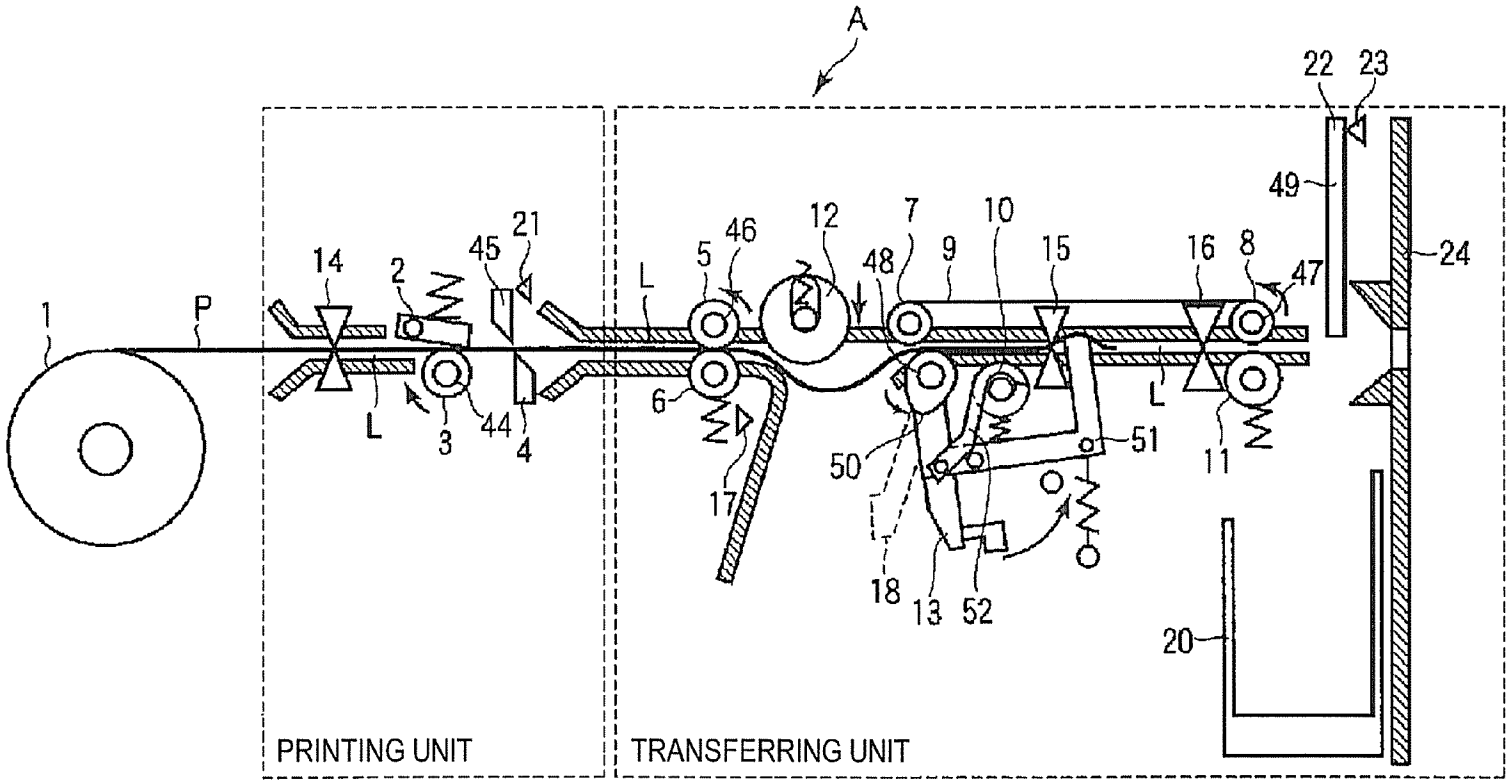
FIG. 5 is a cross-sectional view showing a configuration of bending of the printed paper in the image forming apparatus.
Figure 6:
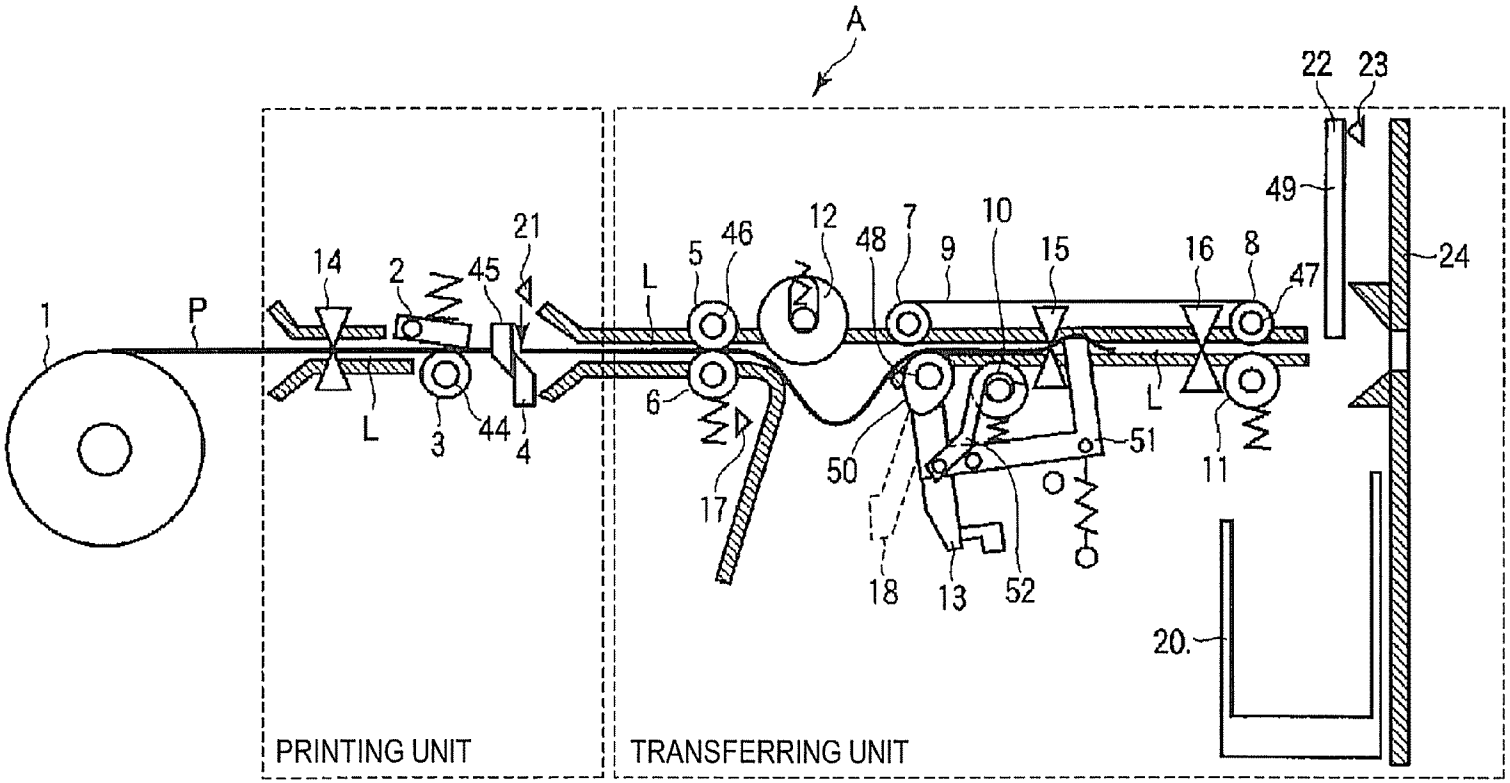
FIG. 6 is a cross-sectional view showing a configuration of cutting the printed paper in the image forming apparatus.

As a result, as shown in the cross-sectional views of FIGS. 5 and 6, the paper P becomes curved enough to avoid the situation in which the paper P may be exposed through the outlet while printing is being performed.

When the CPU 31 recognizes that the printing of the paper P is completed (Act A16), the shutter 51 is moved toward the bottom side of the apparatus, while the second pinch roller 10 is returned to a pinching position by the link arm 52, to enable the conveyance of the paper P (Act A22). Then, the paper P is further conveyed by a predetermined length, e.g. by a distance corresponding to m (where m is a natural number) lines of print data (Act A23) and then the first feed motor 46 is stopped (Act A24). The second feed motor 47 is also stopped (Act A25). Thereafter, under the control of the CPU 31, the cutter 4 cuts the paper P (Act A26). Then, under the control of the CPU 31, the first feed motor 46 and the second feed motor 47 rotate (Act A27).

Figure 7:
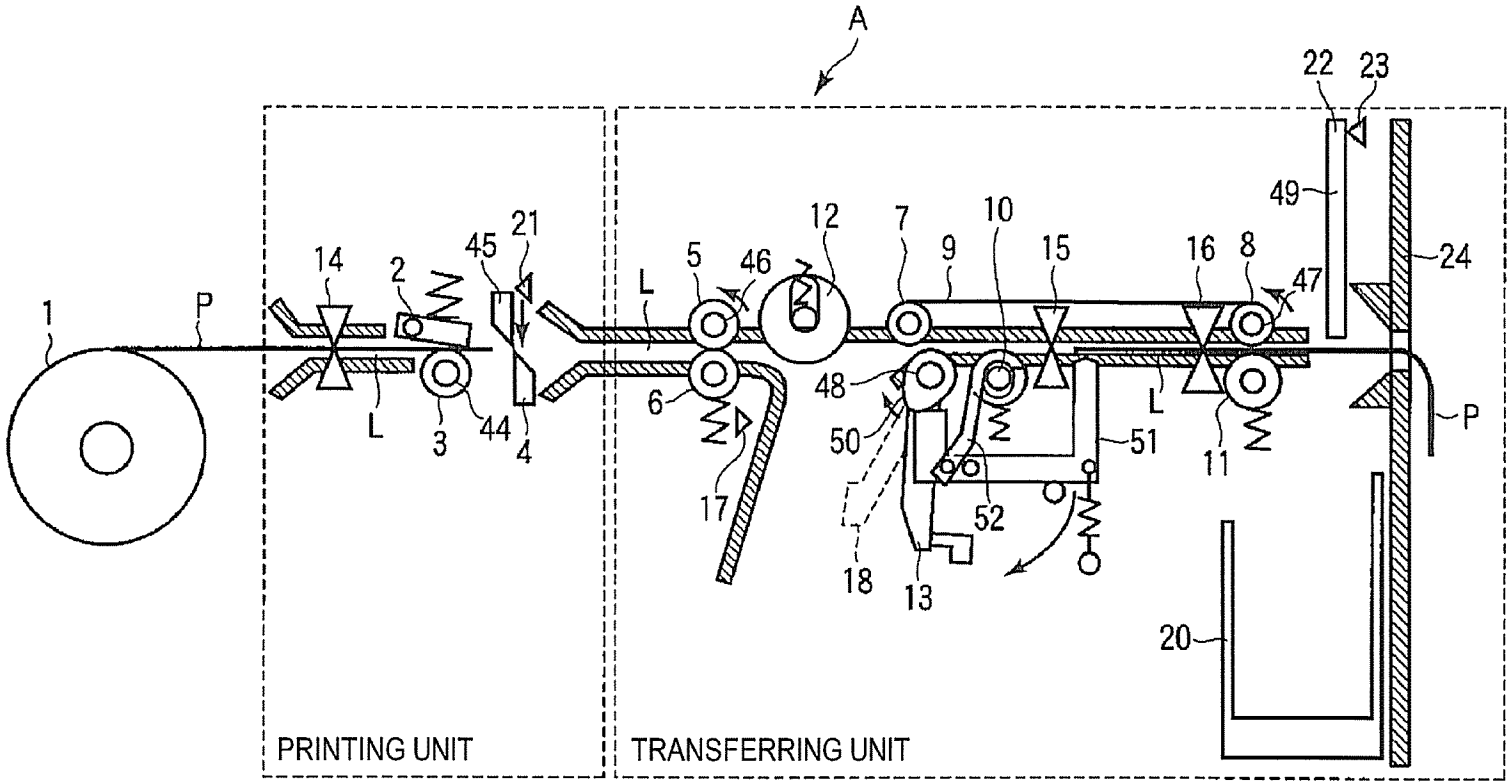
FIG. 7 is a cross-sectional view showing a configuration of discharging the paper cut in the image forming apparatus.

As shown in the cross-sectional view of FIG. 7, when the paper entry sensor 15 detects a rear end of the paper P (Act A28), the CPU 31 stops the rotation of the first feed motor 46 (Act A29). Thereafter, as shown in the cross-sectional view of FIG. 8, when the CPU 31 determines that the paper P has been moved by a predetermined length (Act A30), the CPU 31 stops the rotation of the second feed motor 47 (Act A31). In this situation, the user can take the printed paper P (for instance, a receipt) (Act A32). Thus, during the printing of the paper P, the paper P is not conveyed to the downstream portion of the conveying path L since the shutter 51 moves toward the conveying path L to cause the paper to be pressed or to block the conveying path L. Further, an area of the surface of the paper P pressed by the shutter 51 is not limited and it may be possible to block only a portion of the conveying path L, as shown in FIGS. 14A and 14B. Furthermore, since the flapper 13 moves towards the bottom side to enlarge a space along the conveying path L, the paper P may be allowed to be bent. Therefore, exposure of the paper P outside the apparatus during the printing can be avoided so that the user cannot accidently pull the paper P until printing has been completed.

Figure 8:
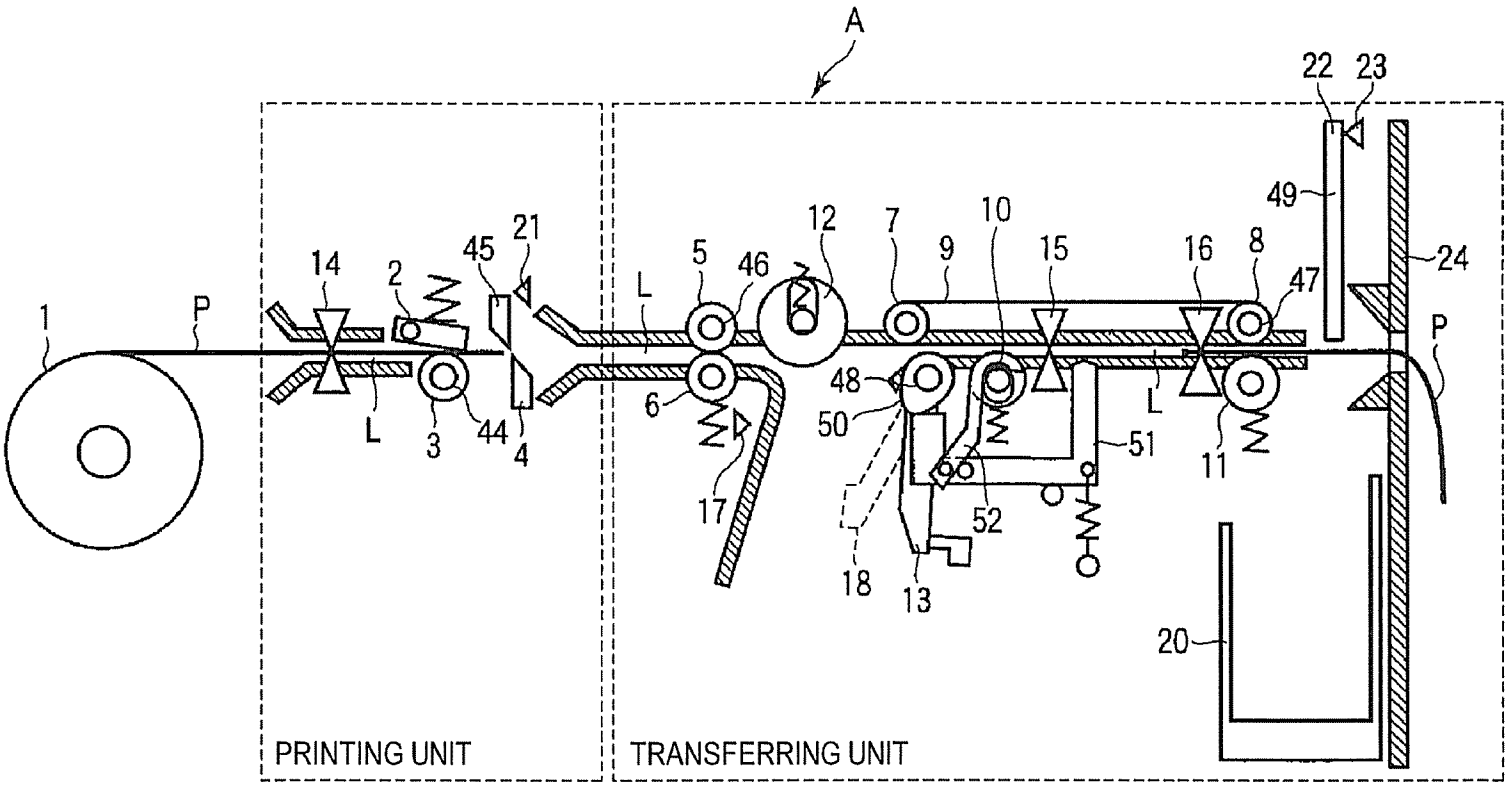
FIG. 8 is a cross-sectional view showing a stand-by state after the completion of the paper discharge in the image forming apparatus.
Figure 9:
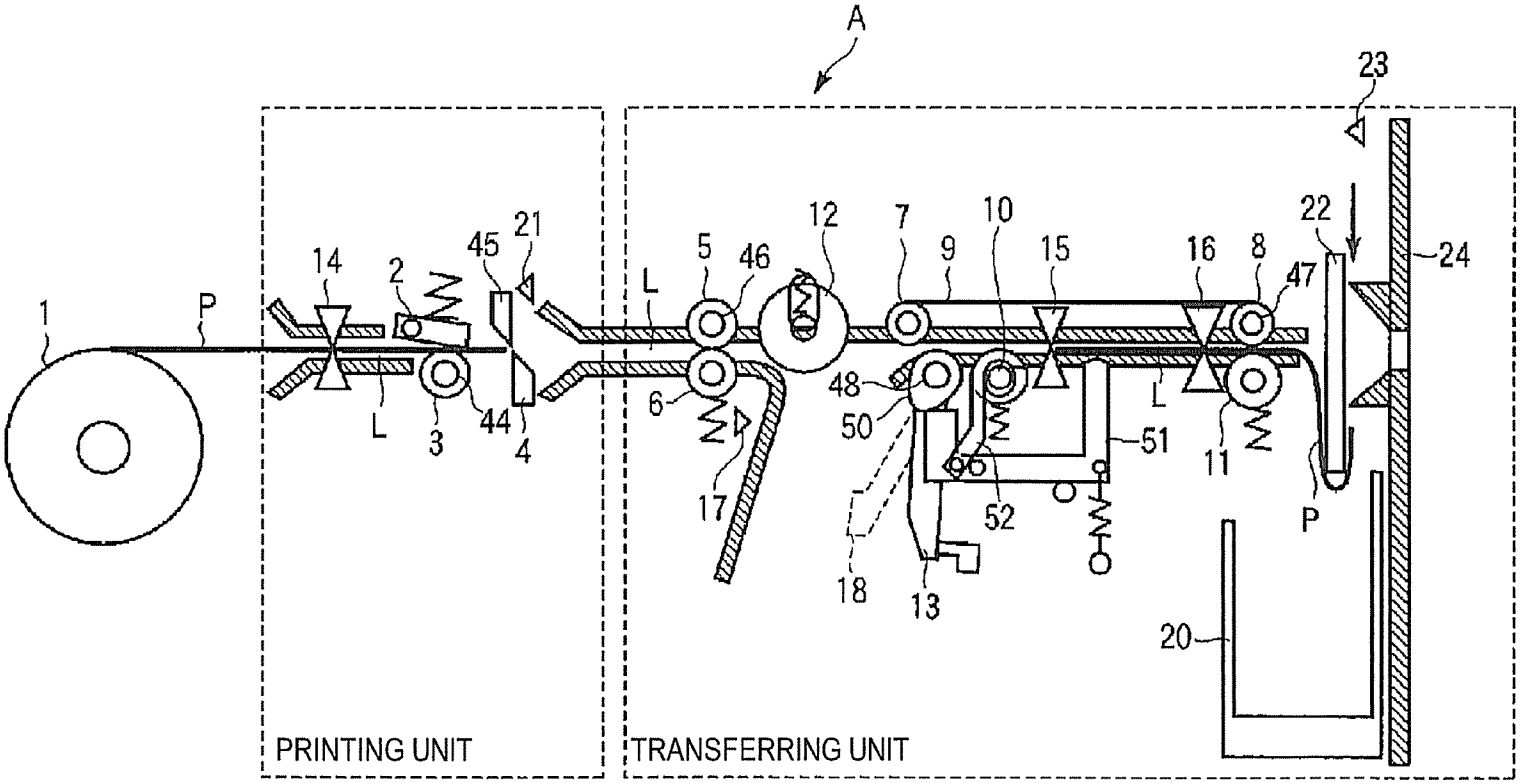
FIG. 9 is a cross-sectional view showing a configuration of collecting the paper within the image forming apparatus.

In the state shown in the cross-sectional view of FIG. 8, when the CPU 31 recognizes that a predetermined time (for example, one minute) has passed (Act A33) and the paper, discharge sensor 16 determines that a user has taken the printed paper P as expected (Act A34), the flapper motor 48 rotates in a reverse direction (Act A35) to move the flapper 13 to its home position, thereby closing the conveying path L. When it is detected that the flapper 13 has closed the conveying path L at its home position (Act A36), the CPU 31 stops the flapper motor 48 (Act A37).

However, in the state shown in the cross-sectional view of FIG. 8, when, based on the detection result from the paper discharge sensor 16, it is determined that the user has not taken paper P for the predetermined time (for example, one minute) (Act A34), the CPU 31 allows the paper P to be collected inside the case 24. In one embodiment, the CPU 31 rotates the second feed motor 47 in a reverse direction for collection of the paper P (Act A38) until the paper entry sensor 15 detects the rear end of the paper P (Act A39). When the paper entry sensor 15 detects the rear end of the paper P (Act A39), the CPU 31 controls the capture shutter 22 to move downward (Act A40), as shown in the cross-sectional view of FIG. 9. This allows the paper P to be retracted out of the outlet. Thereafter, the CPU 31 controls the capture shutter 22 to move upward (Act A41) until the capture shutter home position sensor 23 detects the capture shutter 22 (Act A42), and then stops the capture shutter 22.

Then, the CPU 31 controls the second feed motor 47 (Act A43) to rotate forward. The second feed motor 47 continues to rotate (Act A46) until a predetermined time has passed (Act A45) after the paper discharge sensor 16 first detects the non-existence of paper P (Act A44).

Figure 10:
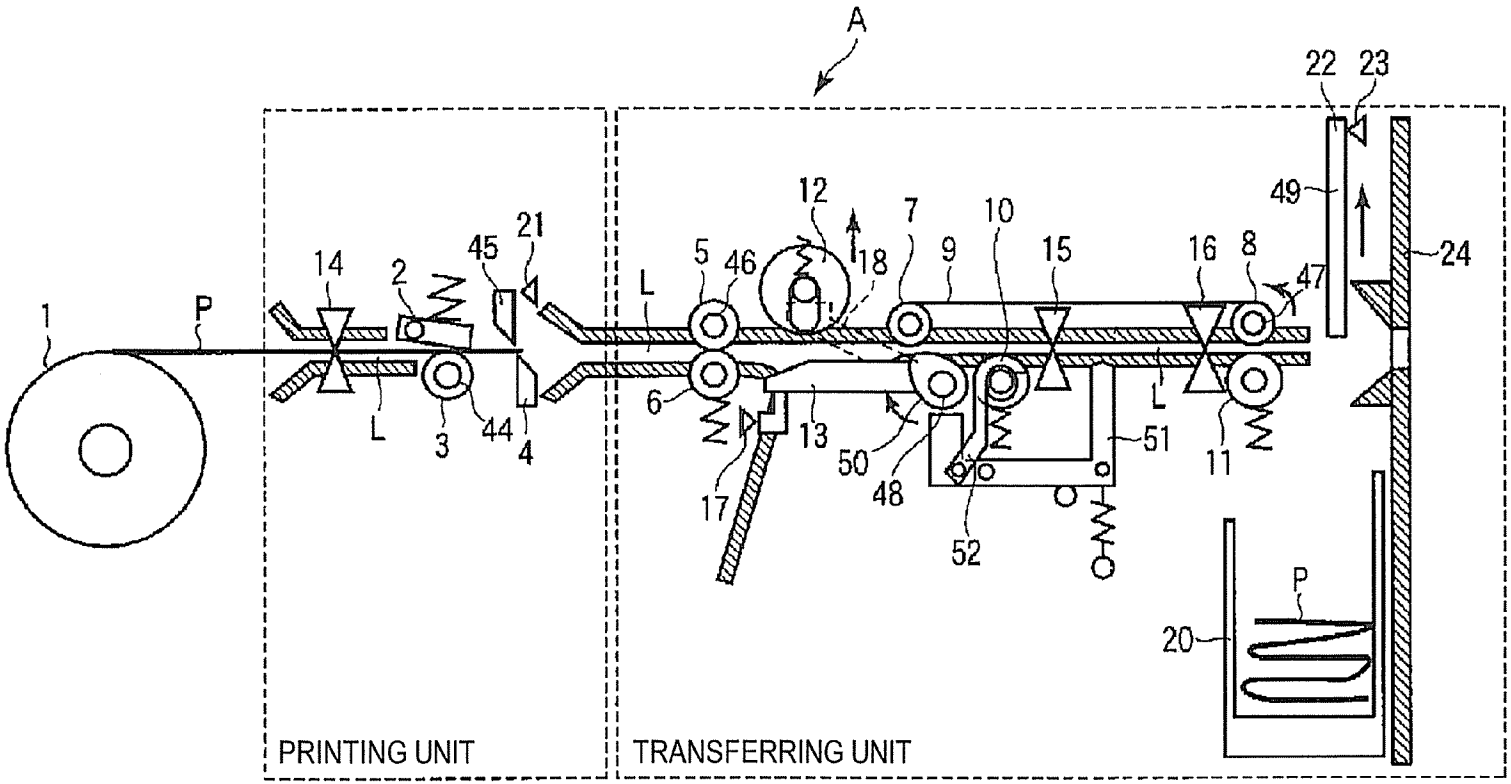
FIG. 10 is a cross-sectional view showing a state after the completion of collecting the paper within the image forming apparatus.
Figure 11:
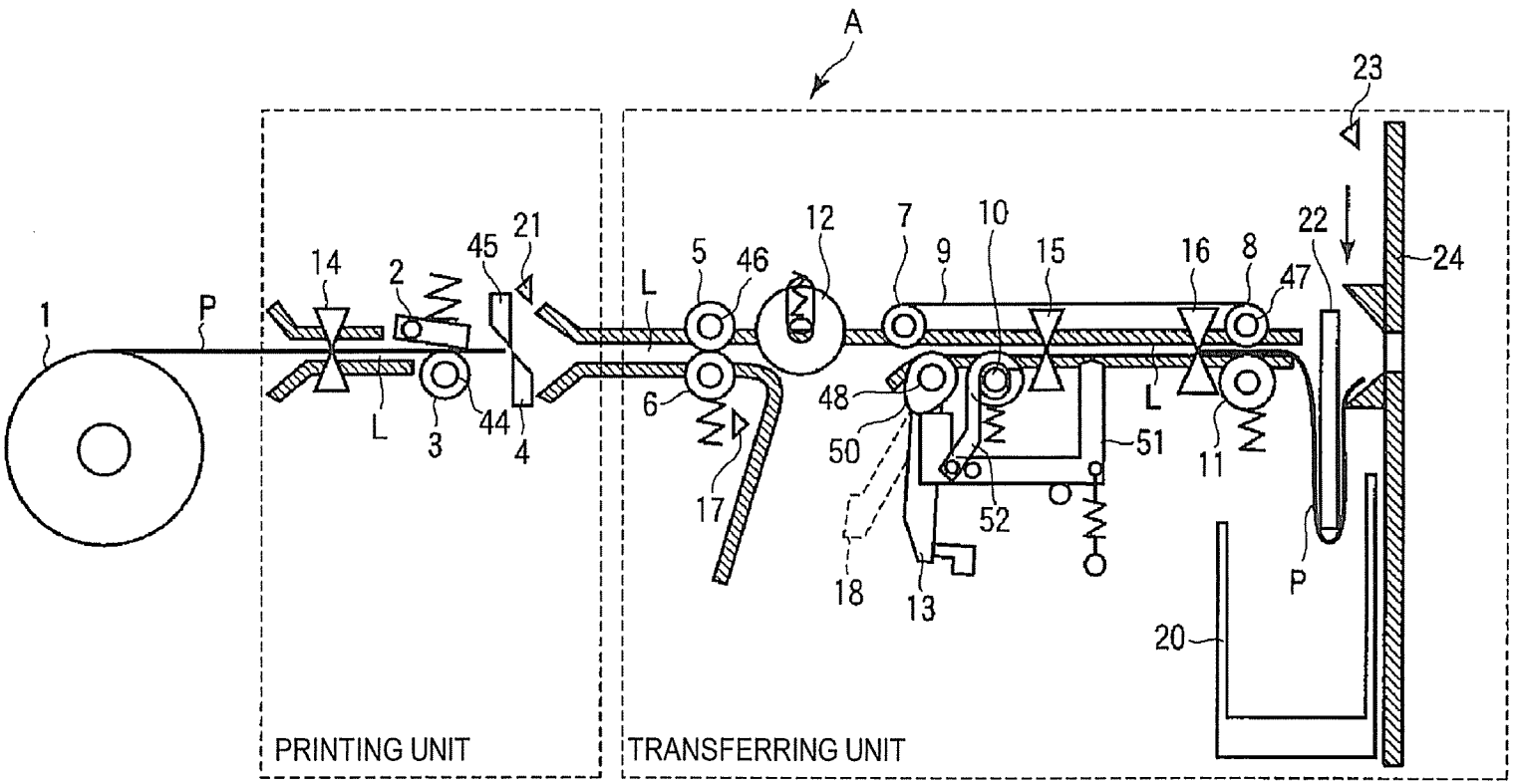
FIG. 11 is a cross-sectional view showing a configuration of collecting the paper within the image forming apparatus by using a capture shutter without reverse rotation of a feed motor.

Thus, as shown in the cross-sectional view of FIG. 10, the paper P is discharged out of the conveying path L to be collected into a capture bin 20.

Thereafter, the CPU 31 rotates the flapper motor 48 in a reverse direction to move the flapper 13 upward to close the conveying path L (Act A47). When it is determined (e.g., by the flapper home position sensor 17) that the flapper 13 has closed the conveying path L at its home position (Act A48), the CPU 31 stops the flapper motor 48 (Act A49).

According to the above embodiments, when the user does not take the paper even after the predetermined time has elapsed, the second feed motor 47 is rotated in a reverse direction so that the paper is collected in the capture bin 20 by the capture shutter 22.

However, the method of collecting the paper may not be limited to the above embodiments. For example, as shown in the cross-sectional view of FIG. 11, when the user does not take the paper P even after the predetermined time has elapsed, the capture shutter 22 may be lowered to introduce the paper P into the capture bin 20 without rotating the feed motor 47 in a reverse direction. In this way, the paper P can be collected more quickly because it does not require the time period to move the second feed motor 47 in a reverse direction, compared to the embodiments described above.

Figure 12:
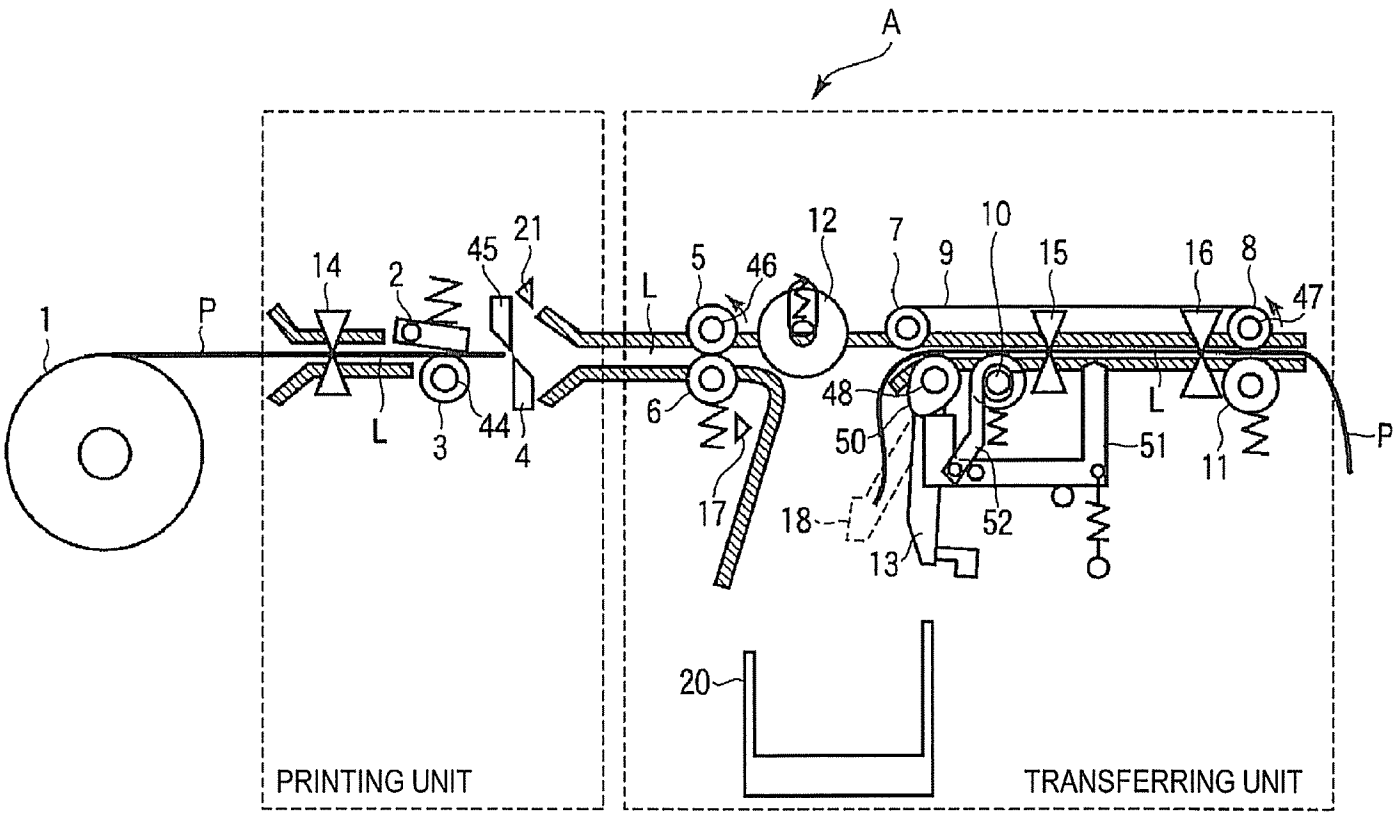
FIG. 12 is a cross-sectional view showing a configuration of collecting the paper, within the image forming apparatus by rotating the feed motor in a reverse direction without using the capture shutter.
Figure 13:
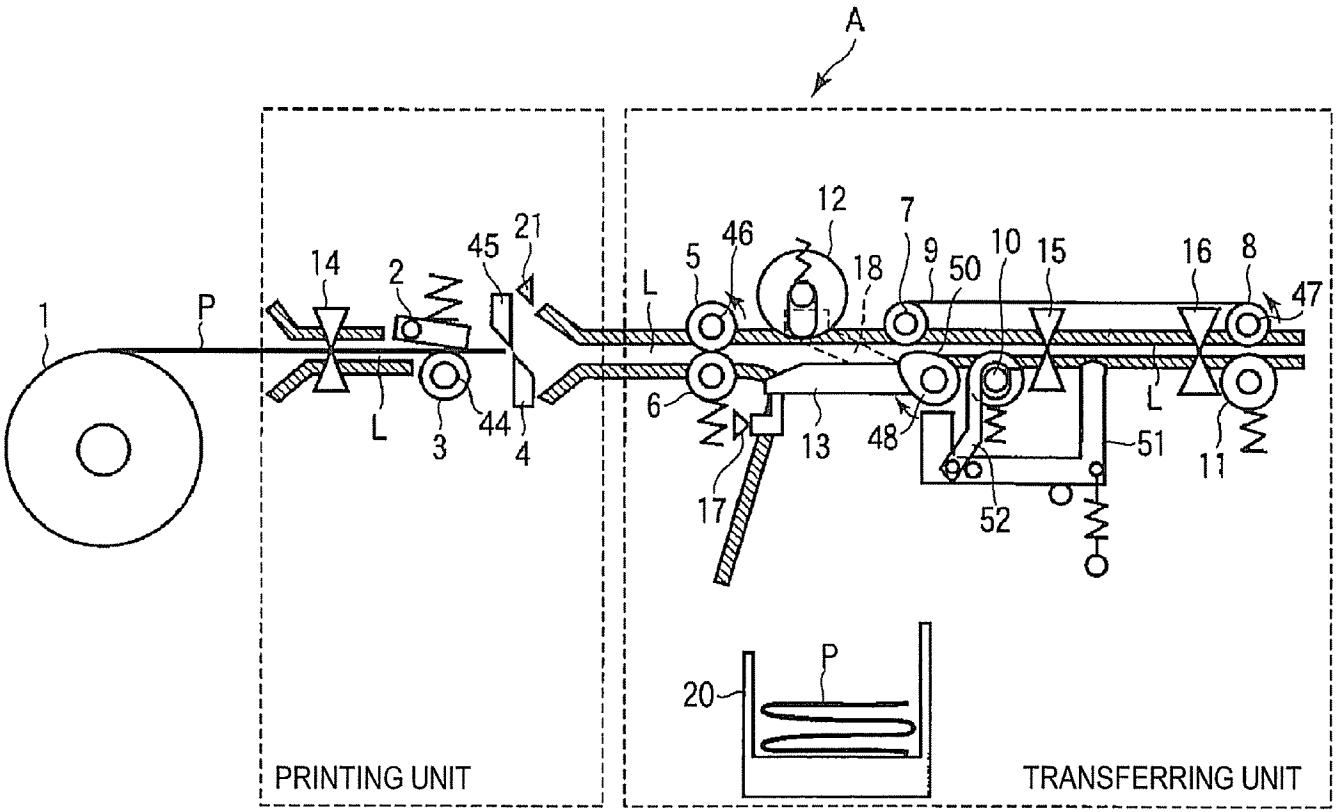
FIG. 13 is a cross-sectional view showing a configuration of the paper which has been collected within the image forming apparatus by rotating the feed motor in a reverse direction without using the capture shutter.

Further, as shown in the cross-sectional view of FIG. 12, the paper P may be collected in a capture bin 20 provided below the flapper 13, without necessitating the use of capture shutter 22. In the configuration shown in FIG. 12, when the user does not take paper P even after the predetermined time has elapsed, the paper P can be collected in the capture bin 20 provided below the flapper 13 by rotating the second feed motor 47 in a reverse direction, as shown in FIG. 13.

As mentioned above, in the image forming apparatus (or paper discharge apparatus) A of the embodiments, an exposure of the paper P outside the apparatus is prevented while the printing is being performed thereon by employing the configuration in which the shutter 51 blocks the conveying path L. Accordingly, this resolves the problem of a user accidently pulling the paper before printing has been completed. In addition, if printing has been completed for the paper P and the user does not take the paper after a predetermined time period, the paper P is collected inside the case of the apparatus by lowering the capture shutter 22. Thus, troubles such as jams due to any subsequently discharged paper can be prevented.

Further, when the flapper 13 is controlled to move downward and open the conveying path, the lift arm 18 and the loop roller 12 are lowered at the same time. Thus, the deflected portion of the paper P can be properly guided downward. As a result, the bending of the paper P can be made stably, regardless of the winding direction of the paper roll 1.

As used in this application, entities for executing the actions can refer to a computer-related entity, either hardware, a combination of hardware and software, software, or software in execution. For example, an entity for executing an action can be, but is not limited to being, a process running on a processor, a processor, an object, an executable, a thread of execution, a program, and a computer. By way of illustration, both an application running on an apparatus and the apparatus can be an entity. One or more entities can reside within a process and/or thread of execution and an entity can be localized on one apparatus and/or distributed between two or more apparatuses.

The program for realizing the functions can be recorded in the apparatus, can be downloaded through a network to the apparatus and can be installed in the apparatus from a computer readable storage medium storing the program therein. A form of the computer readable storage medium can be any form as long as the computer readable storage medium can store programs and is readable by the apparatus such as a disk type ROM and a solid-state computer storage media. The functions obtained by installation or download in advance in this way can be realized in cooperation with an OS (Operating System) in the apparatus.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a conveying path configured to convey a paper from an upstream portion to a downstream portion;

a printing mechanism configured to perform printing on the paper; a preventing mechanism provided on the conveying path and configured to prevent the paper from being conveyed to the downstream portion by performing at least one of pressing the paper and blocking the conveying path; and a case provided at an end of the conveying path and having an outlet for discharging the paper;

a capture shutter which is a vertical plunger bar configured to move vertically to move the paper from the outlet to an inside portion of the case by pushing the paper after at least a part of the paper is exposed through the outlet, the capture shutter being arranged separate from the preventing mechanism between the conveying path and the outlet; and a control unit configured control the preventing mechanism to bend the paper to prevent the paper from being conveyed to the downstream portion, and convey the paper to the downstream portion for a discharge of the paper from the conveying path after the printing mechanism completes the printing on the paper.

2. The apparatus of claim 1, further comprising:

a cutter configured to cut the paper, wherein the control unit conveys the paper to the downstream portion of the conveying path to discharge the paper from the conveying path after the printing mechanism completes the printing on the paper and the paper is cut by the cutter.

3. The apparatus of claim 1, further comprising:

a paper entry sensor provided on the conveying path, the paper entry sensor configured to detect a leading end of the paper, wherein the control unit controls the preventing mechanism to prevent the paper from being conveyed to the downstream portion if the paper entry sensor detects the leading end of the paper.

4. The apparatus of claim 1, further comprising: a flapper provided on the conveying path, the flapper configured to form a space on the conveying path to allow the paper to be bent.

5. The apparatus of claim 4, further comprising:

a loop roller provided on the conveying path and configured to move upward or downward in response to movements of the flapper to bend the paper.

6. A method of forming an image in an image forming apparatus including a conveying path configured to convey a paper from an upstream portion to a downstream portion, a printing mechanism configured to perform printing on the paper, and a prevent mechanism provided on the conveying path and configured to prevent the paper from being conveyed to the downstream portion, the method comprising:

moving the preventing mechanism to press the paper or block the conveying path, thereby bending the paper by preventing the paper from being conveyed to the downstream portion;

after the printing mechanism completes printing on the paper, moving the preventing mechanism to a position to neither press the paper nor block the conveying path and conveying the paper to the downstream portion of the conveying path;

exposing at least a part of the paper through an outlet provided in a case of the apparatus positioned at an end of the downstream portion of the conveying path; and collecting the paper inside of the case of the apparatus if a predetermined time has elapsed by moving a capture shutter which is a vertical plunger bar arranged between the outlet and the conveying path to move the paper from the outlet to an inside portion of the case.

7. The method of claim 6, wherein conveying the paper to the downstream portion is performed after the printing mechanism completes the printing on the paper and the paper is cut by a cutter.

8. The method of claim 6, wherein the conveyance of the paper is prevented by the preventing mechanism if a paper entry sensor provided on the conveying path detects a leading end of the paper.

9. The method of claim 6, wherein the paper is bent by movements of a flapper provided on the conveying path to form a space on the conveying path.

10. The method of claim 9, wherein the image forming apparatus further includes a loop roller provided on the conveying path, and the paper is bent by movements of the loop roller in response to the movements of the flapper.

* * * * *